US005249750A

United States Patent [19]

Gundlach et al.

[11] Patent Number: 5,249,750

[45] Date of Patent: Oct. 5, 1993

[54] TRAVERSING ROLL BREAKER APPARATUS

[75] Inventors: Theodore F. Gundlach, Belleville, Ill.; James D. Fraser, Salt Lake City, Utah; Patrick W. Ryan; Randall S. Shinn, both of Gillette, Wyo.

[73] Assignee: T.J. Gundlach Machine Company, Belleville, Ill.

[21] Appl. No.: 668,893

[22] Filed: Mar. 13, 1991

[51] Int. Cl.[5] ..... B02C 13/09

[52] U.S. Cl. ..... 241/69; 241/86; 241/101.7; 241/195; 241/205

[58] Field of Search ..... 241/69, 86, 186 R, 189 R, 241/195, 205, 101.7

[56] References Cited

U.S. PATENT DOCUMENTS

| | | | |
|---|---|---|---|
| 3,051,459 | 8/1962 | Witzenburg | 241/101.7 |
| 3,698,648 | 10/1972 | Rose | 241/33 |
| 4,077,573 | 3/1978 | Kersey et al. | 241/32 |
| 4,378,094 | 3/1983 | Williams | 241/186 R |

FOREIGN PATENT DOCUMENTS

| | | | |
|---|---|---|---|
| 2749313 | 5/1979 | Fed. Rep. of Germany | 241/186 R |

*Primary Examiner*—Mark Rosenbaum
*Assistant Examiner*—John M. Husar
*Attorney, Agent, or Firm*—Cohn, Powell & Hind

[57] ABSTRACT

This apparatus (10) for reducing lumps of coal, and the like, on a grid (14) disposed over a material-receiving area (16) includes a carriage (12) guided across the grid (14) on a track (44) by a drive system (50) and having roll assemblies (60) mounted thereto. Each roll assembly (60) includes a drive roll (62) having stationary shaft assemblies (66,68) mounted to the carriage (12) and driven by an internally mounted motor (78), and a set of pick rings (64) mounted to the drive roll (62) at longitudinally spaced intervals and having pick circles with picks (90) pointing in both directions. The material-receiving area includes a conveyor system which, when the area is wide, includes a longitudinal conveyor (100) flanked by a plurality of lateral feeder conveyors (102).

12 Claims, 5 Drawing Sheets

TRAVERSING ROLL BREAKER APPARATUS

BACKGROUND OF THE INVENTION

This invention relates generally to apparatus for crushing large lumps of minerals such as coal, ore, and bulk materials such as overburden, and in particular to such apparatus having an improved crushing roll and conveyor system.

Crushing apparatus of the kind under consideration is well known in the prior art as exemplified by U.S. Pat. No. 3,698,648 which discloses a grid for receiving coal dumped from railroad cars and crushed by a carriage-mounted rotating shaft having radial hammer-like projections for striking and reducing the large lumps of material as the shaft traverses the grid. The reduced material falls into a hopper and is conveyed to a remote point for processing. In this apparatus the drive means for the shaft is mounted on one of the carriages and the carriages are pulled back and forth over the grid by a chain and sprocket system attached to the carriages and extending lengthwise of the grid.

The shaft drive system of U.S. Pat. No. 3,698,648 is separate from the rotating shaft and must therefore be connected to the shaft by a conventional pulley or gear drive system both of which suffer from the disadvantage of operating in an exposed, dust-laden environment. In addition, the use of a conventional hopper and conveyor system below the grid tends to limit the width of the grid.

The present apparatus overcomes these and other disadvantages in a manner not disclosed in the known prior art.

SUMMARY OF THE INVENTION

This transversing roll breaker apparatus includes a roll or set of rolls having internally mounted motors to improve the drive and a conveying system or controlled feeder system, or the like, disposed beneath the grid to improve the conveying of the reduced material for remote processing.

The mounting of the drive motors internally has the advantage that virtually no external moving parts are subjected to the destructive effects of the dust-laden environment.

This traversing roll breaker apparatus for reducing lumps of material on a grid disposed over a material-receiving area, includes carriage means, track means guiding the carriage means across the grid, roll means including shaft means having opposed ends operatively mounted in non-rotatable relation to the carriage means and an outer cylindrical casing mounted in rotatable relation to the shaft means, and motor means inside the roll means for rotating the outer casing relative to the shaft means, striker means circumferentially arranged on the roll means for reducing lumps of material as the roll rotates and the carriage means moves across the grid and means for moving the carriage means across the grid.

Another aspect of this invention is to provide drive means for the roll means which includes means reversing the direction of rotation of the roll means.

It is an aspect of this invention to provide that the track means includes a pair of tracks and the carriage means is generally U-shaped and includes a pair of carriage sections each mounted to a track and an upper frame extending between and connecting the carriage sections.

It is another aspect of this invention to provide that each carriage means includes an upper portion and means suspended from the upper portion for mounting the shaft means.

It is yet another aspect of this invention to provide that the striker means includes a plurality of rings fixedly attached to the outer casing of the roll means in spaced relation lengthwise of the roll means, each ring including a plurality of circumferentially disposed pick elements.

Another aspect of this invention is to provide rings which are selectively spaced to suit the size reduction required for the crushed material.

It is still another aspect of this invention to provide that the pick elements are mounted to the rings in removable relation, some of said pick elements pointing generally in a direction opposite to other of said pick elements.

It is a further aspect of this invention to provide that each track includes upper and lower track members and the carriage includes wheels received between said members to resist upward movement of said carriage sections during the crushing process.

It is another aspect of this invention to provide that a pair of roll means is disposed in axially aligned relation, each roll means having an electric motor means therewithin.

Another aspect of this invention is to provide that a material-receiving area disposed below the grid having a width substantially as wide as the grid, and to provide a conveyor system in the material-receiving area including a longitudinal conveyor and a plurality of lateral feeder conveyors.

Yet another aspect of this invention is to provide that the longitudinal conveyor is disposed intermediate the width of the of the material-receiving area and the feeder conveyors are disposed on both sides of said longitudinal conveyor. Still another aspect of this invention is to provide that the longitudinal conveyor is disposed at one side of the material-receiving area and the feeder conveyors are disposed on one side of said longitudinal conveyor.

It is an aspect of this invention to provide a traversing roll breaker which is relatively simple and inexpensive to manufacture and maintain and which is highly efficient in operation.

DESCRIPTION OF THE PREFERRED EMBODIMENTS

Figure 1:
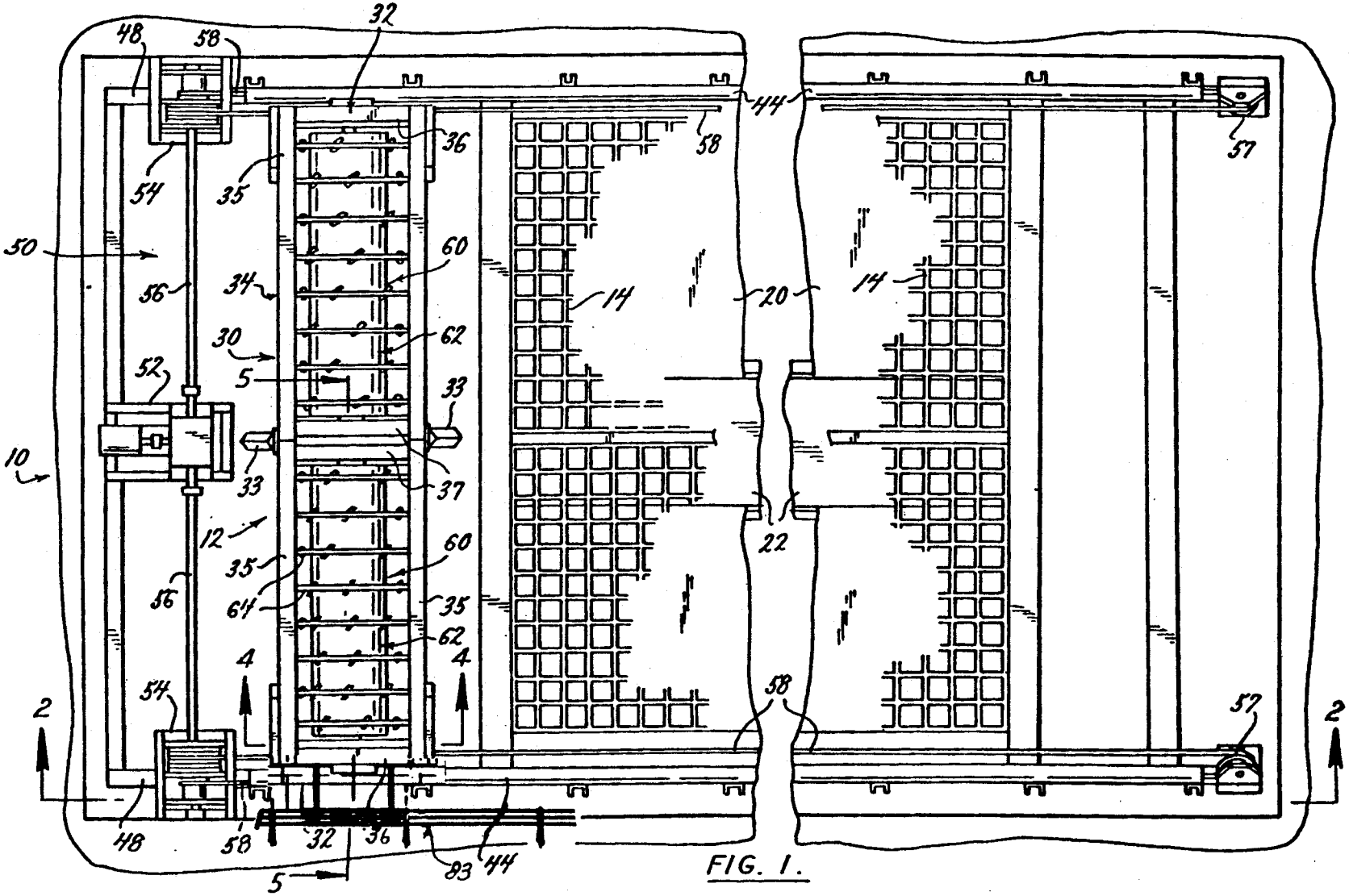
FIG. 1 is a plan view of the roll breaker apparatus.
Figures 2, 6:
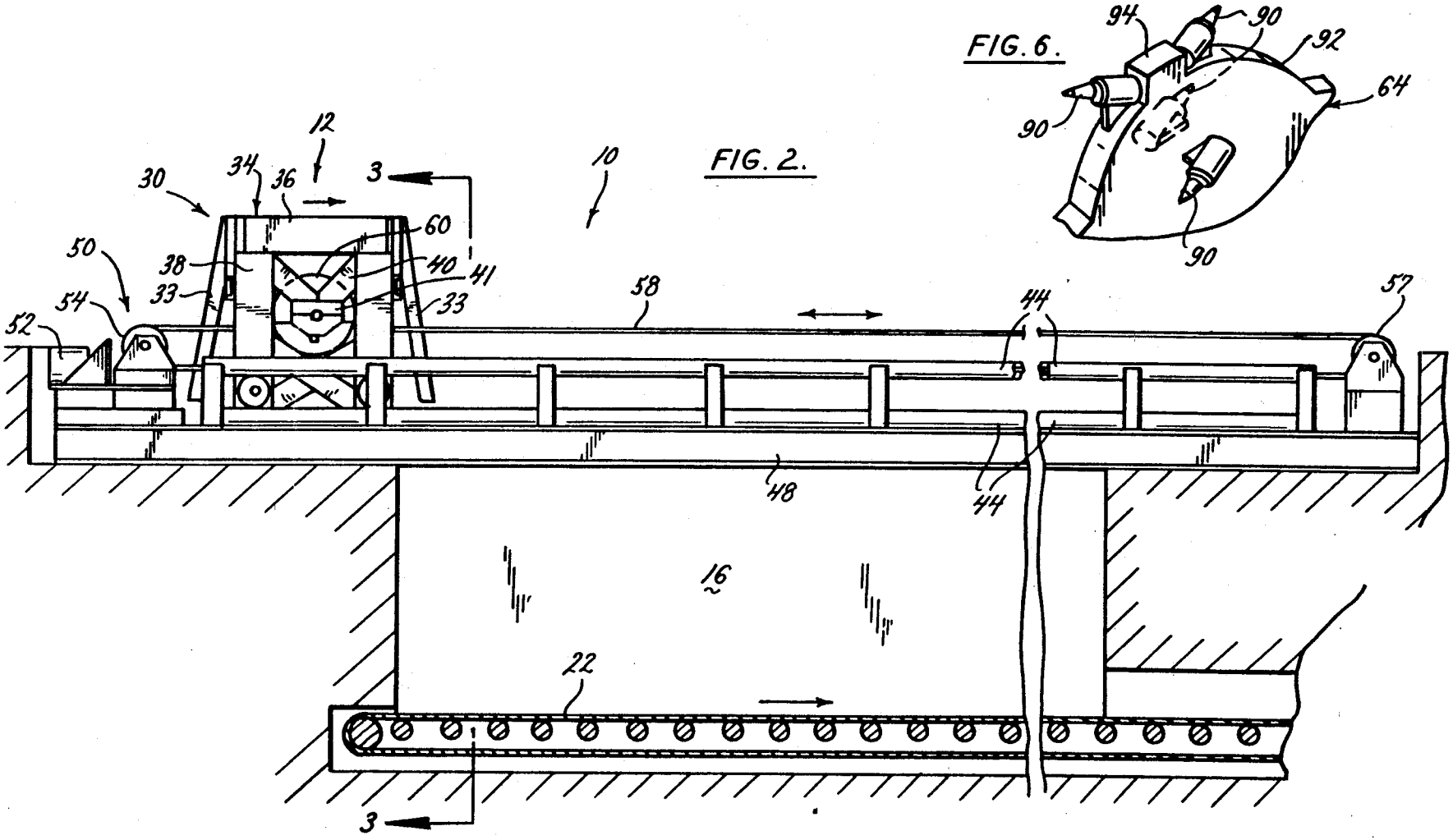
FIG. 2 is a longitudinal sectional view taken on lines 2—2 of FIG. 1.
FIG. 6 is an enlarged fragmentary perspective view showing the pick arrangement.
Figure 3:
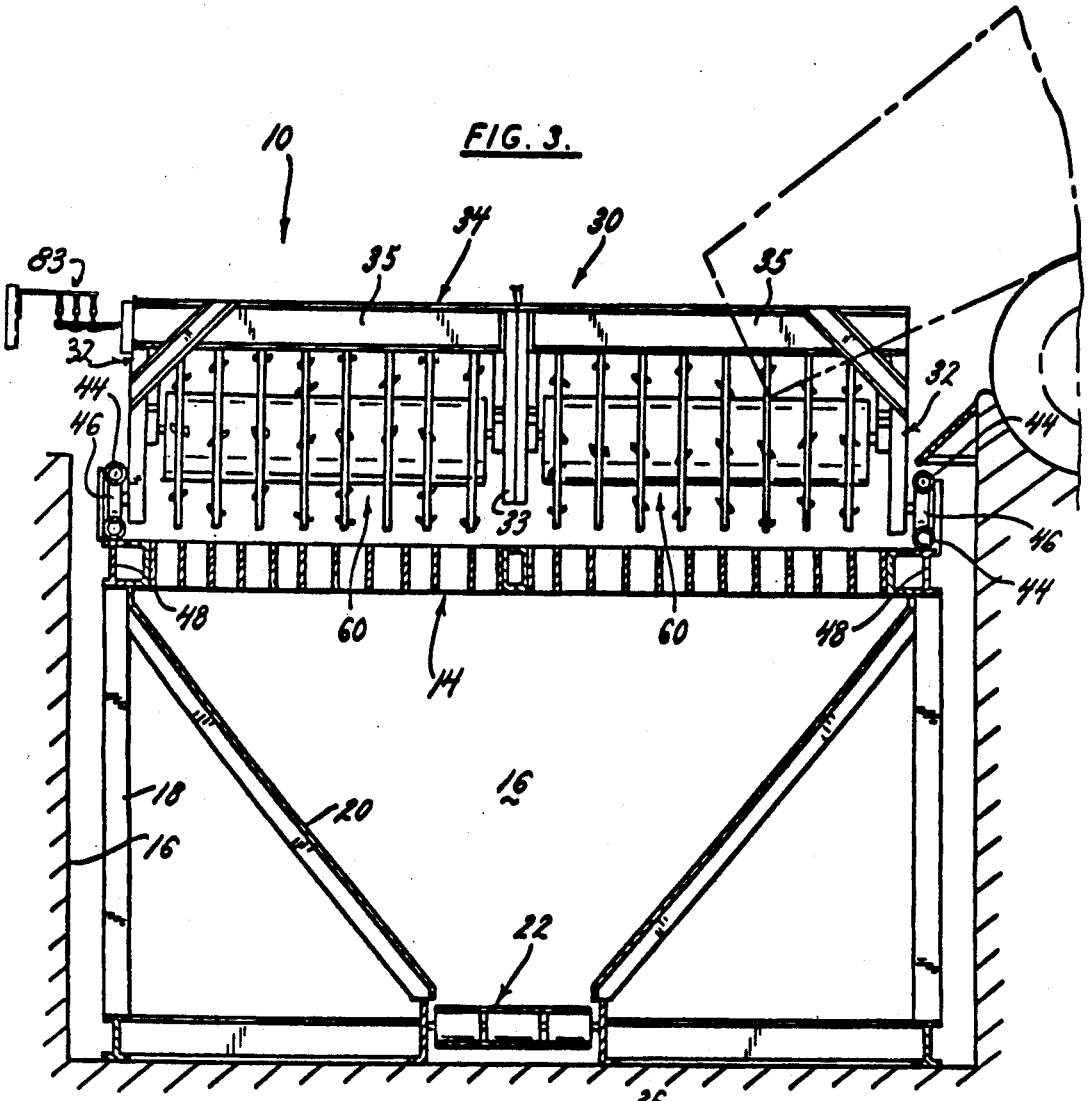
FIG. 3 is a cross-sectional view taken on lines 3—3 of FIG. 2.

Referring now by reference numerals to the drawings and first to FIGS. 1-3 it will be understood that the crushing apparatus 10 includes a roll breaker assembly 12 which traverses back and forth across a grid 14 disposed over a material-receiving area provided within a pit 16. As shown, the grid 14 is carried by a support structure 18 and the material-receiving area is defined by a hopper 20 having a longitudinal conveyor system 22 at its lower end.

The roll breaker assembly 12 includes a carriage assembly 30 of generally inverted U-shaped configuration having opposed carriage end sections 32 interconnected by upper frame 34 having elongate members 35, end members 36 and intermediate members 37. Each end section 32 includes side members 38 and a cross frame 39. Inclined plow members 33 are welded, or otherwise attached, to the upper frame 34. The carriage assembly 30 includes suspended end supports 40 providing shaft mounting means 41 and similar intermediate supports 42 providing intermediate shaft mounting means 43. In the embodiment shown, two roll assemblies 60 are provided each being carried between an end shaft mounting means 41 and an intermediate shaft mounting means 43.

The carriage assembly 30 is mounted on opposed tracks 44 by outrigger wheels 46 carried by the side members 38 of each end section 32, the tracks being welded or otherwise secured to associated longitudinal grid members 48. Each track includes a pair of spaced longitudinally extending upper and lower members interconnected by transverse members and this arrangement provides the carriage assembly 30 with resistance against uplift during the crushing process.

The carriage assembly 30 is pulled back and forth across the grid 14 by a drive system 50 at one end of the grid which includes a drive motor 52. The drive motor 52 is mounted intermediate two shaft-driven cable winches 54, coupled to said motor by shafts 56, idler pulleys 57 being provided at the other end of the grid. The winches 54 each drive a cable 58 which is attached at its ends to associated carriage section 32 with the lower flight of the cable passing through the upper member of the track 44.

Figure 4:
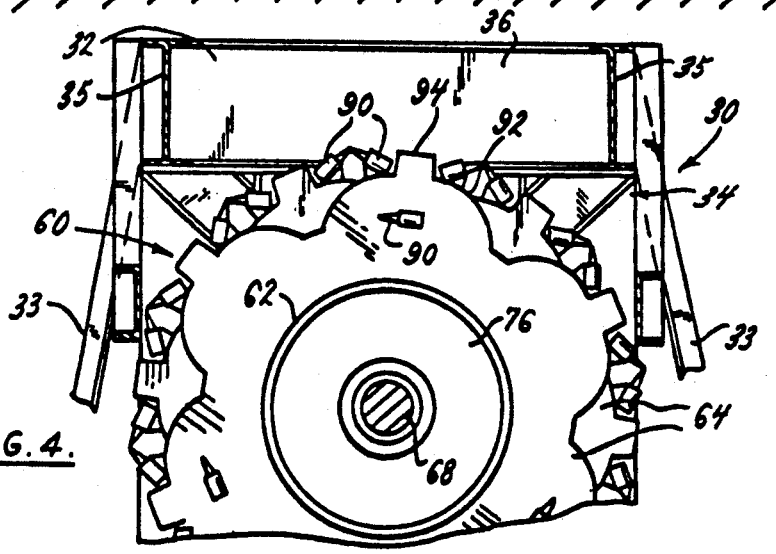
FIG. 4 is an enlarged fragmentary view of the carriage and roll assembly taken on line 4—4 of FIG. 1.
Figure 5:
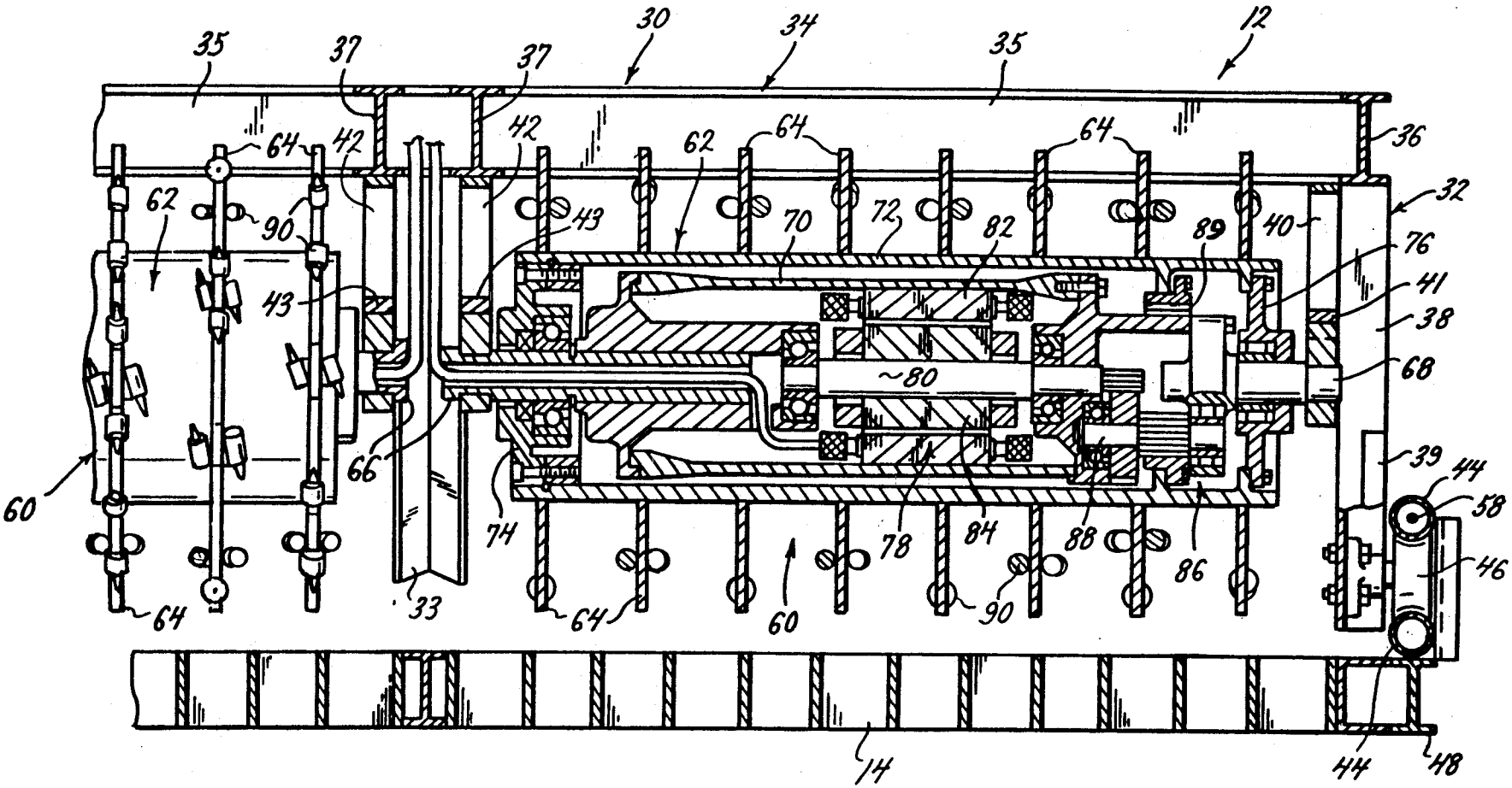
FIG. 5 is a longitudinal sectional view taken on lines 5—5 of FIG. 1.

The roll assemblies 60, constituting roll means, are best shown by reference to FIGS. 4 and 5. As shown, each roll assembly includes a central drive roll 62 having longitudinally spaced pick rings 64 attached thereto, constituting striker means. The drive rolls are of the type manufactured, for example, by Van der Graaf of Holland, Interroll/Joki of Denmark and others as shown for example, in the Vander Graaf catalog No. TM 03-88-1/imp dated 1988 under TM 127 which is incorporated herein by reference. Drive rolls of this type are conventionally used as stationary drive rolls for belt conveyor systems.

Briefly, each drive roll 62 includes stationary inner and outer shaft assemblies 66 and 68 fixedly mounted in non-rotatable relation between shaft mounting means 41 and 43 on the carriage assembly 30 and interconnected by a non-rotatable motor housing 70. A rotatable exterior roll shell 72 having end caps 74 and 76 is mounted to the stationary shaft assemblies 66 and 68. An internal motor assembly 78, constituting a roll drive means, is provided including a motor shaft 80 mounted between the shaft assemblies 66 and 68. The motor assembly includes a stator 82 carried by the motor housing 70 and a rotor 84 which is carried by the motor shaft 80. When power is supplied by cable to the stator, through the hollow inner stationary shaft assembly 66, the rotor 84 is energized and, through a reducer gear system, generally indicated by numeral 86, rotates the roll shell 72 of each drive roll 62 thereby rotating the pick rings 64. In the embodiment shown, the reducer gear system 86 includes an idler 88 having one part engageable with an end gear of the shaft 80 and another part engageable with a ring gear 89 fixedly attached, as by bolting, to the roll shell 72. This internal drive arrangement minimizes the exposure of moving parts in a potentially dust laden environment. Power is supplied to the motor cable in a conventional manner by conductor bar assembly, as shown in FIGS. 1 and 3 by numeral 83, festoon assembly or reel assembly such as shown in U.S. Pat. No. 3,698,648 incorporated herein by reference.

The roll pick rings 64 are formed from plates generally annular in configuration and are welded, or otherwise attached, to the outside of the roll shell 72 of each drive roll 62. The pick rings 64 are spaced lengthwise of the roll to suit the particular material being crushed. The plow members 33, attached to the frame 34, push material to be crushed away from the area between the drive rolls 62 and into the vicinity of the pick rings.

In the embodiment illustrated the pick rings 64 are configurated, as best shown in FIGS. 4 and 6, to provide inner and outer circles of picks 90. To this end, each ring plate 64 includes a plurality of outstanding portions 92 each including central portion 94 having picks 90 mounted on each side and facing in opposite directions to define the outer circle of picks. The inner circle of picks is defined by picks 90 disposed on each side of alternating outstanding portions 92, the picks on one side facing in the opposite direction to the picks on the other side. This structural arrangement of the picks ensures that equal crushing ability will be provided in both longitudinal directions of roll travel. In the preferred embodiment the picks 90, which constitute striker means, include holders which are attached, as by welding to the rings 64. Preferably the individual pick elements are removable and replaceable. Also, as shown in FIG. 4, alternating ring plates 64 are staggered so that the outstanding portions of one ring plate are disposed between the outstanding portions of its neighboring ring plates.

Figure 7:
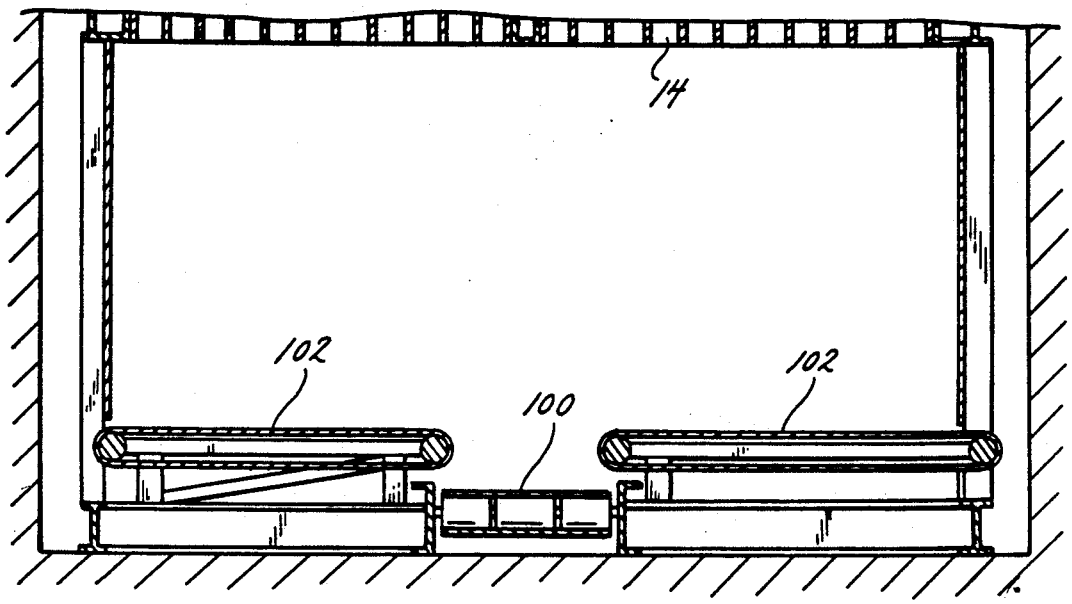
FIG. 7 is a generally schematic view of a modified conveyor system.
Figure 8:
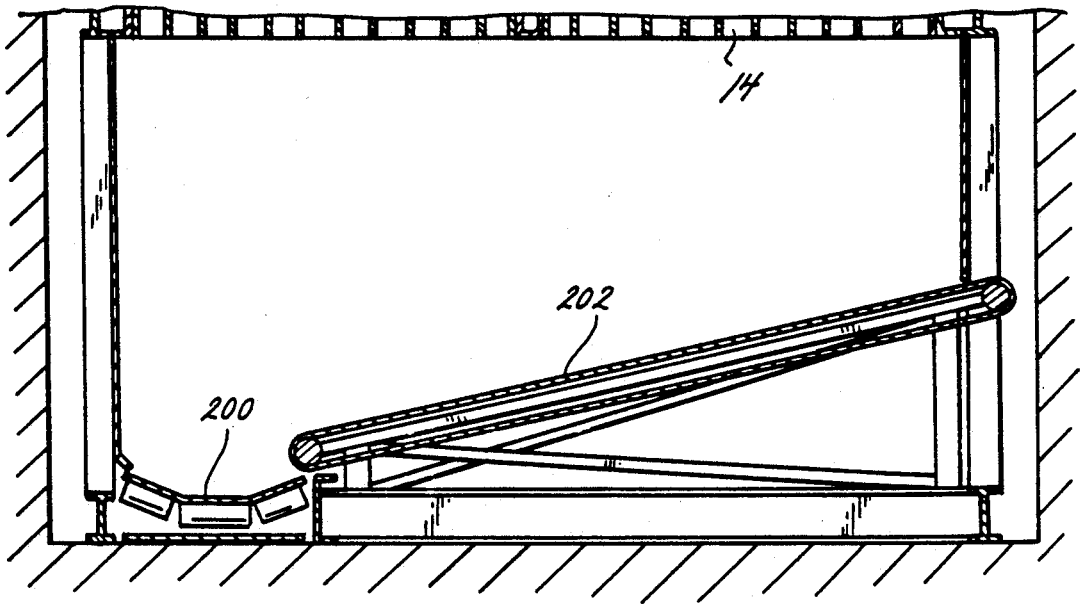
FIG. 8 is a similar view of another modified conveyor system.

FIGS. 7 and 8 show modified conveyor systems for use where the grid 14 is relatively wide and the material-receiving area is relatively shallow. As shown in FIG. 7 a central longitudinal conveyor 100 is used with a plurality of flanking lateral conveyors 102 on each side. The number of lateral conveyors 102 used is determined by the length of the grid 14 and will normally be between twelve feet and twenty-five feet (12-25 ft.) wide. Preferably, both the longitudinal and lateral conveyors are of the type using internal motors. The conveyor system shown in FIG. 8 includes a side longitudinal conveyor 200 which is used with a plurality of flanking conveyors 202 on one side only.

It will be understood that although the improved roll breaker apparatus has been described by making particular reference to preferred embodiments, the details of description are not to be understood as restrictive, numerous variants being possible within the principles disclosed and within the fair scope of the claims hereunto appended.

We claim as our invention:

1. A traversing breaker roll crushing apparatus for reducing lumps of material on a grid disposed over a material-receiving area, the apparatus comprising:

(a) carriage means including a pair of carriage sections and a frame extending between and fixedly connecting the carriage sections together, (b) track means guiding the carriage means across the grid, (c) roll means including shaft means having opposed ends interconnected by motor housing means and operatively mounted in non-rotatable relation to the carriage means and an outer cylindrical casing mounted in rotatable relation to the shaft means, (d) drive means for the roll means including motor means inside the housing means for rotating the outer casing relative to the housing means, (e) striker means circumferentially arranged on the roll means for reducing lumps of material as the roll rotates and the carriage means moves across the grid, and (f) drive means for moving the carriage means across the grid.

2. An apparatus as defined in claim 1, in which:

(g) the drive means for the roll means includes reducer means carried by the motor housing means and driving a ring gear fixedly attached to the casing and means reversing the direction of rotation of the roll means.

3. An apparatus as defined in claim 1, in which:

(g) the track means includes a pair of tracks, and (h) the carriage means is generally U-shaped and includes a pair of carriage sections each mounted to a track and an upper frame extending between and connecting the carriage sections.

4. An apparatus as defined in claim 3, in which:

(i) each track includes upper and lower track members and the carriage includes wheels received between said members to resist upward movement of said carriage sections during the crushing process.

5. An apparatus as defined in claim 1, in which:

(g) each carriage means includes an upper portion and means suspended from the upper portion for mounting the ends of the shaft means.

6. An apparatus as defined in claim 1, in which:

(g) the striker means includes a plurality of rings fixedly attached to the outer casing of the roll means in spaced relation lengthwise of the roll means, each ring including a plurality of circumferentially disposed fixedly operating pick elements.

7. An apparatus as defined in claim 6, in which:

(h) the rings are selectively spaced to suit the size reduction required.

8. An apparatus as defined in claim 6, in which:

(h) the picks elements are mounted to the rings in removable relation, some of said pick elements pointing generally in a direction opposite to other of said pick elements.

9. An apparatus as defined in claim 8, in which:

(i) the drive means for the roll means includes means reversing the direction of rotation of the roll means and the attached rings with the oppositely mounted pick elements.

10. An apparatus as defined in claim 1, in which:

(g) a pair of roll means is disposed in axially aligned relation, each roll means having an electric motor means therewithin.

11. A traversing breaker roll crushing apparatus for reducing lumps of material on a grid disposed over a material-receiving area, the apparatus comprising:

(a) a generally U-shaped carriage means including a pair of carriage sections interconnected by an upper frame, (b) a pair of track means guiding each of the carriage sections across the grid, (c) roll means including shaft means having opposed ends interconnected by motor housing means and operatively mounted in non-rotatable relation to the carriage sections and an outer cylindrical casing mounted in rotatable relation to the shaft means, (d) drive means for the roll means including motor means and reducer means carried by the housing means for rotating a ring gear fixedly attached to the outer casing relative to the housing means, and means reversing the direction of the roll means, (e) striker means circumferentially arranged on the roll means in spaced relation to the grid for reducing lumps of material as the roll rotates and the carriage means moves across the grid, the striker means including a plurality of rings fixedly attached to the outer casing of the roll means in spaced relation lengthwise of the roll means, each ring including a plurality of sets of circumferentially disposed fixedly operating, removable pick elements each set including pick elements point in opposite directions, and (f) drive means for moving the carriage means in opposite directions across the grid so that crushing can be performed by the oppositely pointing pick elements as the apparatus moves in either direction across the grid.

12. An apparatus as defined in claim 11, in which:

(a) each ring includes an outer periphery and opposed faces, (b) each set of pick elements includes a pair of oppositely pointing elements mounted to the outer periphery and a pair of oppositely pointing elements mounted to a face of the ring.

* * * * *